United States Patent [19]

Libit

[11] 4,325,487

[45] Apr. 20, 1982

[54] SEALING AND LOCKING THREAD SYSTEM

[76] Inventor: Sidney M. Libit, 441 Lakeside Ter., Glencoe, Ill. 60022

[21] Appl. No.: 155,406

[22] Filed: Jun. 2, 1980

[51] Int. Cl.[3] ..... B65D 41/04

[52] U.S. Cl. ..... 215/330; 215/344; 215/DIG. 1

[58] Field of Search ..... 215/330, 341, 344, DIG. 1, 215/215, 216

[56] References Cited

U.S. PATENT DOCUMENTS 3,480,170 10/1968 Evans et al. ..... 215/330 X 4,125,201 11/1978 Birch ..... 215/330

*Primary Examiner*—George T. Hall

[57] ABSTRACT

A screw-threaded closure cap to provide sealing of the contents of a container for fluent material upon closing and opening thereof and to provide a wedging torque-controlled securement of the cap to the container. The cap is provided with an internal thread of a pitch essentially identical to the pitch on the neck of the container and cooperates therewith. A continuous helical rib is positioned adjacent the internal cap thread and has a width greater than the depth of the cap thread and the thread on the neck of the container. The helical rib is of resilient material having a good memory. The cap thread is formed as a truncated cone to provide a camming surface cooperative with the helical rib in locking the cap to the container.

3 Claims, 5 Drawing Figures

SEALING AND LOCKING THREAD SYSTEM

FIELD OF THE INVENTION

The present invention lies in the field of screw-threaded closure caps and, more particularly, provides a threaded cap having an auxiliary helical element which serves as an additional seal during the opening and closing of the container and cooperates with the threads on the inner surface of the cap to provide a wedging torque-dependent locking of the cap to the container.

BACKGROUND OF THE INVENTION

So-called locking helical thread systems are well-known; for example, those in which the binding force applied to the fastened parts is increased as tightening torque alters the respective pitch diameters of the male and female elements. U.S. Pat. No. 3,480,170 is of this type. In the cited disclosure, a helical element carried by one part rides on a helical mating element on the other part by means of respective tooth forms which are mutually cammed as the parts are relatively rotated. In this patent, the mutual action causes the pitch diameter of the female element to become effectively smaller. By this interaction, relative axial movement of the two helices is translated into radial pressures and the resistance to inadvertent backing off of one part is increased.

Other examples of threads employing helical locking flanges may be found in U.S. Pat. Nos. 4,125,201 and 3,463,340.

SUMMARY OF THE INVENTION

The present invention is concerned with a threaded engagement incorporating some of the principles set forth in the aforementioned patents but so constructed and arranged as to obtain greatly enhanced friction, i.e., locking force, between the engaged parts. The invention is applicable generally to helically threaded male and female fasteners of uniform or variable pitch diameter.

Briefly, and by way of example, a helical fin is provided adjacent the thread on either the cap or container, illustratively shown and described as on the cap of the present disclosure. The parts are so constructed and arranged that the mentioned rib is progressively deformed and released as it is moved axially upon relative rotation of the parts. During such action, the fin is progressively jammed between the cap and container threads, thus implementing the frictional fit of the elements when the cap is fully secured to the container and vice versa. The degree of binding thus to be realized may be selected by appropriate dimensioning of the parts and/or the coefficient(s) of friction of the material(s).

The helical rib, when not in contact with the thread on the container will engage the neck of the container extending between the container threads.

The improvement disclosed herein allows variation in manufacturing tolerances and allowances for wear in the male and female parts greater than is realizable in locking thread systems heretofore known.

DESCRIPTION OF THE PREFERRED EMBODIMENT

That form of the invention disclosed for purposes of illustration is a form of thread shown and described in the above-mentioned U.S. Pat. No. 3,480,170. Although that thread form provides an engagement of high efficiency, even tighter and more reliable lockup may be achieved by employing the supplemental friction afforded by use of the instant invention. It will be understood that any tooth form, generally represented by a cross-section taken transversely of the longitudinal extent of the thread, is capable of embodying the present invention, provided the camming action is attainable.

Figure 2:
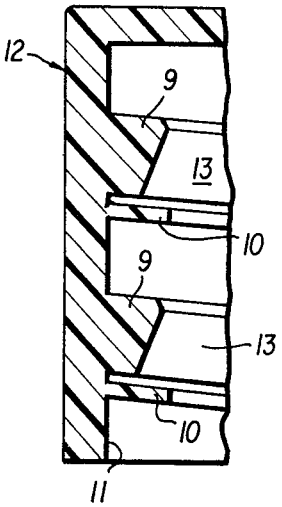
FIG. 2 is a partial medial cross-sectional view of the cap in part, somewhat enlarged, to show the helical fin in inoperative or undeformed condition.

For purposes of the present description, the present invention is incorporated in a single pitch helix thread as a helical rib 9 extending inwardly from the internal surface 11, of the interior of the cap 12. This rib includes a cam surface flank 13 corresponding substantially to a conical surface with its apex on the central axis X—X. Other cross-sections may be availed of so long as the fin 10 of the invention may be cammed into a stressed condition as the male and female elements are relatively rotated clockwise or counter-clockwise about the common axis X—X. In its undeformed condition, e.g., as fabricated, (FIG. 2) the fin 10 will extend radially inwardly toward the axis X—X and essentially parallel to rib 9 and have a width greater than the flight of fin 10.

Figure 3:
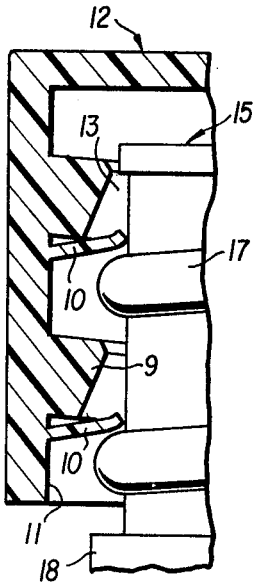
FIG. 3 is a partial, longitudinal, medial cross-sectional view, somewhat enlarged, of an intermediate position of the fin during the securing of the cap to the container.
Figure 4:
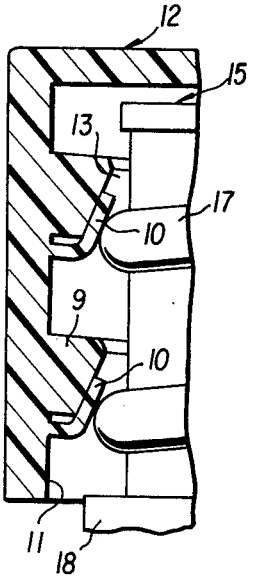
FIG. 4 is a partial, longitudinal medial cross-sectional view of the cap screwed down to its maximum extent with the fin fully deformed and jammed between the principal threads.

In manufacture, the parts 10 and 13 are formed at the same time. The container neck 15 is provided with a thread 17 having a relaxed flight (radial dimension) less than that of the rib 10. Continued relative rotation of the cap 12 about the neck axis 15 will deform the fin 10 from its initial, unstressed position (FIG. 3) into a slightly curled-over condition. As seen in FIG. 3, when the fin is between either the top 15 of the container neck or between the surface of thread 17, and not in contact with thread 17, the fin 10 is seen to be in sealing contact with the the neck 15. It will be apparent from FIG. 3, that the portion of fin 10 which is in contact with thread 17 (which would be on the back or unobserved side of neck 15) will be compressed between rib 10 and thread 17 as shown in FIG. 4. When the cap is finally fully secured to the neck, the position of the fin 10 will be as shown in FIG. 4. It will be evident that, in so doing, the fin is opposed by the thread 17, whereby to substantially implement the force maintaining the male member 18 in implemented frictional engagement with the female member 12 (FIGS. 4 and 5).

Referring to FIG. 4 it will be seen that the dominant force acting between the fin 10 and the rib 9 is substantially in a radial direction whereby to implement the interlocking action of the fastened parts, i.e., the cap 15 and the bottle 18.

Figure 5:
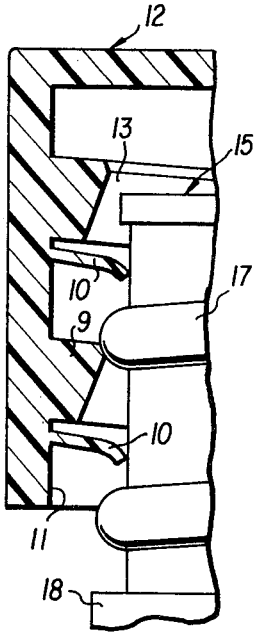
FIG. 5 is a partial medial cross-sectional view, somewhat enlarged, of an intermediate portion of the fin or rib during removal of the cap.

From FIG. 5 it will be seen that, as the cap is being removed from the bottle neck 15, the position of the fin 10 is reversed from that shown in FIG. 3. The position of fin 10 in FIGS. 3 and 5 indicate that, in addition to the sealing action which would be provided between rib 10 and thread 17, that portion of rib 10 which is not between the respective two threads will provide a seal of that portion of neck 15 over an area equal to the pitch of the Thread 17.

Since the fin 10 is fabricated from material having good elastic memory it will be obvious that, upon unscrewing of the parts 12 and 15 they will resume their normal, unstressed condition, pending subsequent deformation.

Figure 1:
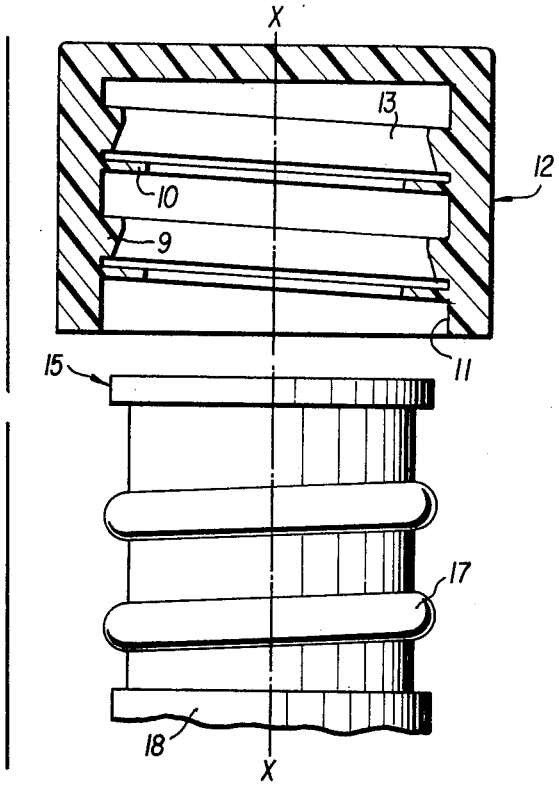
FIG.1 is a medial cross-section of a closure cap shown disengaged from the neck of the container, e.g., a bottle, which is opened and closed by manual relative rotation of the cap and neck. The mating portions of the respective neck and cap are shown as being provided with a screw-threaded connection incorporating the principles of the invention.

One of the salient advantages of the invention resides in this: that an initial degree of looseness of the neck and cap is readily accommodated by the tendency of the curled portion of the fin 10 to uncurl to its initial, unloaded condition (FIG. 1). Stated otherwise, a screw-threaded connection utilizing the principles of the invention is self-adjusting, compressing into its curled condition upon screwing up, and restoring to its initial, relaxed, essentially flat form upon unscrewing, in proportion to the measure of elastic memory possessed by the fin and the parts sharing in the function.

What is claimed:

1. A self-locking thread system incorporated in male and female threadedly-engaged parts and to be locked-up in response to relative rotation of the parts, one of the said parts being provided with a helical thread having a transverse cross-section of substantially trapezoidal configuration to present a camming working face, a helical fin positioned below said thread on said same part and having a width greater than the thread flight, the pitch of the fin and thread being the same, the other threaded part being so dimensioned and arranged so that relative rotation of the parts will cause the camming surface to deflect the fin into a jamming position between said threaded parts to bind the parts against inadvertent unscrewing thereof.

2. In a thread system comprising a male helical element rotatably and threadably engaged on a common axis with a female helical element to translate relative rotary motion of the elements into relative axial movement of the elements, each of the elements having mutually confronting threads, the improvement wherein said female element thread has a transverse cross-section of substantially trapezoidal configuration which forms a downwardly sloping camming surface and a helical fin on the interior of the female element spacedly positioned below said female element thread and parallel to the upper surface thereof extending inwardly and adapted to be abutted by the male helical element, the principal plane of the fin being substantially at right angles to the axis of rotation, and the fin, in the disengaged condition of the elements, having a radial extent so relasted that upon relative rotation of the elements the fin is deformed in radial and axial directions by said male element and said camming surface into a jamming position between the respective threads of said elements to increase the radial and axial frictional forces between the two elements in their engaged contition and placing them in a sealed and locked position.

3. A self-locking thread system comprising a male part and a female hollow cylindrical part to receive the male part, said parts being rotatably engaged, a helical fin and a helical rib extending from the inner wall of the female member, the helical rib having a trapezoidal transverse cross-section and a working face which is a conical helix with its apex coincident with the common axis of the male and female parts, said helical rib being coextensive in the direction of its length with the helical fin, the pitch of the fin and the rib being the same, the fin adapted to be deformed by the rib upon relative rotation of the said parts to a jamming position between said parts to increase the friction therebetween to preclude inadvertent backing off of the said parts attributable to shock and vibration.

* * * * *